US008814326B2

(12) United States Patent
Nystrom et al.

(10) Patent No.: US 8,814,326 B2
(45) Date of Patent: Aug. 26, 2014

(54) REDUCED MECHANICAL COUPLING WITH STRUCTURED FLEX CIRCUITS

(71) Applicant: Xerox Corporation, Norwalk, CT (US)

(72) Inventors: Peter J. Nystrom, Webster, NY (US); Bryan R. Dolan, Rochester, NY (US); Bradley James Gerner, Flagstaff, AZ (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/644,009

(22) Filed: Oct. 3, 2012

(65) Prior Publication Data

US 2014/0092175 A1 Apr. 3, 2014

(51) Int. Cl.
*B41J 2/14* (2006.01)
*B41J 2/16* (2006.01)

(52) U.S. Cl.
USPC ..... 347/50

(58) Field of Classification Search
None
See application file for complete search history.

(56) References Cited

U.S. PATENT DOCUMENTS

2003/0055337 A1* 3/2003 Lin ..... 600/459
2004/0169705 A1* 9/2004 Murai ..... 347/71
2011/0298871 A1* 12/2011 Stephens et al. ..... 347/50

* cited by examiner

*Primary Examiner* — Matthew Luu
*Assistant Examiner* — Erica Lin
(74) *Attorney, Agent, or Firm* — MH2 Technology Law Group LLP

(57) ABSTRACT

An actuator assembly including a flexible printed circuit and a method for making such an actuator assembly are provided. The flexible printed circuit includes a body having a top side and a bottom side, with the body defining a plurality of bumps extending from the bottom side. A first bump of the plurality of bumps is disposed adjacent to a second bump of the plurality of bumps, and the body further defines at least one relief configured to reduce movement of the second bump caused by movement of the first bump. The flexible printed circuit also includes a plurality of contact pads disposed on the bottom side of the body at least partially at the plurality of bumps, with the plurality of contacts pads being configured to be electrically coupled to a power source and to a piezoelectric transducer.

5 Claims, 6 Drawing Sheets

REDUCED MECHANICAL COUPLING WITH STRUCTURED FLEX CIRCUITS

FIELD OF THE DISCLOSURE

The present disclosure relates generally to piezoelectric actuators for inkjet printers.

BACKGROUND

Piezoelectric inkjet print heads often include an actuator assembly, which can include an array of piezoelectric transducers attached to a flexible diaphragm. When a current is supplied to a piezoelectric transducer, typically through electrical connection with an electrode, the piezoelectric transducer bends or deflects. The deflection of the piezoelectric transducer causes the diaphragm to flex. Flexing the diaphragm displaces a volume of ink from a chamber, generally pushing it through a nozzle. When the current is removed from the piezoelectric transducer, the diaphragm returns to its original position, drawing ink into the chamber from a main ink reservoir through an opening, thus replacing the expelled ink.

To provide such an actuator assembly, an adhesive layer is initially applied to the array of transducers. The adhesive layer is applied with apertures extending therethrough, with the apertures being aligned with the piezoelectric transducers. Conductive epoxy (e.g., silver epoxy) is then stenciled or otherwise inserted into the aperture. An electrically conductive metallization, often referred to as a flexible printed circuit, is then positioned over the adhesive and epoxy layer. The flexible printed circuit generally includes conductive traces leading to electrical contacts (or "contact pads"). The contact pads are electrically coupled with the piezoelectric transducers via the conductive epoxy. Accordingly, electrical current can be selectively applied to a specified piezoelectric transducer along a path proceeding through a trace, to a contact, through the conductive epoxy, and to the piezoelectric transducer.

Although this approach is satisfactory for a variety of print heads, the conductive epoxy is known to extrude out of the apertures, as the diaphragm flexes and moves during operation. This can result in the conductive epoxy forming an unintended electrical path from traces and/or contacts adjacent the aligned contact to the transducer and/or to adjacent transducers. Accordingly, this extruding of the epoxy can ground or short the power circuit and/or result in unintended actuation of adjacent transducers.

To overcome this challenge, embossed or "bumped" flexible printed circuits have been successfully implemented. In bumped flexible printed circuits, the flexible printed circuit itself is deformed at the contact pad, such that the flexible printed circuit extends outward from the remainder, nominally planar, portion of the flexible printed circuit, forming the characteristic bump. When the flexible printed circuit is received onto the adhesive layer, the contacts extend through the apertures in the adhesive layer and physically contact the piezoelectric transducer, obviating a need for conductive epoxy.

However, a challenge experienced with such bumped designs results from the mechanical coupling of the flexing piezoelectric transducer with the flexible printed circuit. That is, with physical contact between the flexible printed circuit and the piezoelectric transducer, the flexible printed circuit tends to move along with the piezoelectric transducer. In contrast, such movement is generally isolated from the flexible printed circuit in non-bumped, conductive-epoxy embodiments, as the conductive epoxy generally has a low modulus and tends to avoid transmitting such motion. In the bumped flexible printed circuits, this movement can also be mitigated by maintaining a low modulus in the flexible printed circuit itself; however, there is a lower limit on the modulus of the flexible printed circuit, so as to preserve structural integrity.

In many situations, the actuators are spaced apart far enough, such that the movement in the flexible printed circuit caused by the mechanical coupling is of little or no consequence. However, as actuator density increases, enabling increased-resolution printing, the actuators are placed closer and closer together in the print head. Accordingly, in some situations, the movement of the flexible printed circuit can affect adjacent actuators, for example, causing the diaphragms to move slightly even though no current has been supplied to the transducer in the adjacent actuator. This occurrence, often referred to as "cross-talk," can result in an artificial upper limit on the density of the actuators on the print head.

What is needed, then, are improved apparatus and methods for limiting physical coupling between adjacent actuators.

SUMMARY

Embodiments of the disclosure may provide a flexible printed circuit for an actuator assembly in a print head. The flexible printed circuit includes a body having a top side and a bottom side, with the body defining a plurality of bumps extending from the bottom side. A first bump of the plurality of bumps is disposed adjacent to a second bump of the plurality of bumps, and the body further defines at least one relief configured to reduce movement of the second bump caused by movement of the first bump. The flexible printed circuit also includes a plurality of contact pads disposed on the bottom side of the body at least partially at the plurality of bumps, with the plurality of contacts pads being configured to be electrically coupled to a power source and to a piezoelectric transducer.

Embodiments of the disclosure may also provide a method for forming an electrical interconnect in an actuator assembly for a print head. The method includes forming a plurality of bumps in a flexible printed circuit, and forming a plurality of contact pads on a bottom side of the flexible printed circuit, with the plurality of contact pads being at least partially disposed at the plurality of bumps. Further, the plurality of contact pads are electrically coupled to a power source via one or more traces disposed along a bottom side of the flexible printed circuit. The method also includes reducing a thickness of one or more sections of the flexible printed circuit to reduce a stiffness of the flexible printed circuit between two or more of the plurality of bumps.

Embodiments of the disclosure may also provide an actuator assembly for an inkjet printer. The actuator assembly includes an array of piezoelectric actuators, and a diaphragm coupled with the array of piezoelectric actuators, with the diaphragm being configured to displace a volume of ink when one or more of the array of piezoelectric elements is excited. The actuator assembly also includes a standoff layer disposed adjacent to the array of piezoelectric actuators, such that the array of piezoelectric actuators is disposed between the standoff layer and the diaphragm. The standoff layer defines apertures therethrough aligned with at least some of the array of piezoelectric transducers. The actuator assembly further includes a flexible printed circuit disposed adjacent to the standoff layer. The flexible printed circuit includes a body having a top side and a bottom side, with the body defining a plurality of bumps extending from the bottom side. The plurality of bumps are aligned with and extending at least partially through the apertures of the standoff layer. The flexible printed circuit also includes a first contact pad disposed on the bottom side of the body and at least partially at one or more of the plurality of bumps. The first contact pad physically contacts at least one of the array of piezoelectric transducers. The flexible printed circuit also includes a second contact pad disposed on the bottom side of the body and at least partially at one or more of the plurality of bumps. The second contact pad physically contacts at least one of the array of piezoelectric elements. Further, the body defines at least one relief configured to reduce movement of the second contact pad caused by movement of the first contact pad.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings.

FIG. 1 illustrates a partial perspective view of an actuator assembly for a print head, according to an embodiment.

Figure 7:
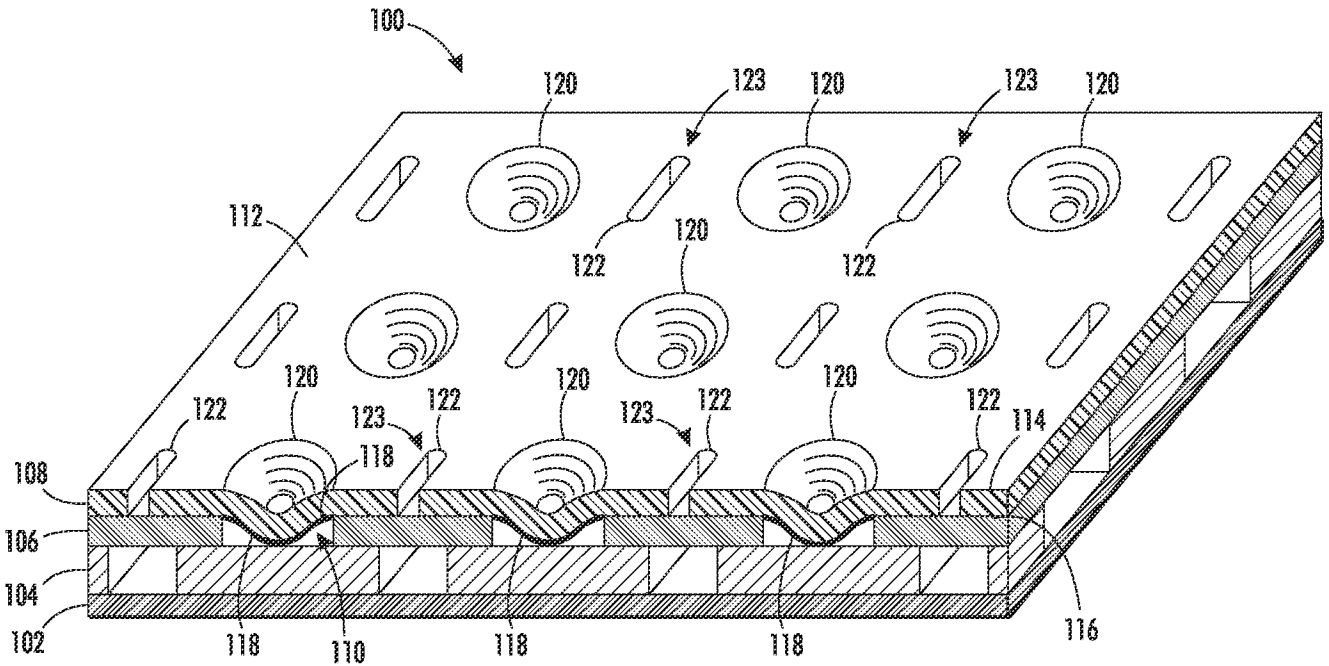

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawing. In the drawings, like reference numerals have been used throughout to designate identical elements. In the following description, reference is made to the accompanying drawing that forms a part thereof, and in which is shown by way of illustration a specific exemplary embodiment in which the present teachings may be practiced. The following description is, therefore, merely exemplary.

Generally, embodiments of the present disclosure provide a bumped flexible printed circuit with areas of reduced thickness ("reliefs") formed between at least some of the adjacent bumps, at the bumps, or both. The inclusion of the reliefs may serve to reduce the displacement of the bumps caused by displacing an adjacent bump ("cross-talk"). More particularly, the bumps of the flexible printed circuit may be in physical contact with the associated transducers, so as to apply current thereto. When current is applied to the transducer, it flexes, which tends to move the bump in contact therewith. The reliefs reduce the cross-sectional area of the flexible printed circuit, which may allow the bump to be more easily displaced, but may also localize the displacement of the bump, such that the displacement of one bump does not substantially affect the position of adjacent bumps. Thus, cross-talk between adjacent bumps, and thus adjacent transducers, may be reduced.

Turning now to the specific, illustrated embodiments, FIG. 1 depicts a partial perspective view of an actuator assembly 100, according to an embodiment. The actuator assembly 100 may be configured for use in a print head of an inkjet printer. More particularly, the actuator assembly 100 may be disposed adjacent to an ink path or chamber and/or a nozzle plate, such that the actuator assembly 100 is configured to eject ink from the chamber and/or path, through nozzles in the nozzle plate, as well as draw the ink into the chamber and/or path for the next round of ejection.

The actuator assembly 100 may generally include a plurality of layers, which may be stacked, one on top of the other in a generally parallel arrangement. For example, the actuator assembly 100 may include a diaphragm 102, an array of actuators 104, a standoff layer 106, and a flexible printed circuit 108.

The diaphragm 102 may be constructed of one or more metals such as titanium, nickel, stainless steel, another metal alloy, for example, any suitable metal alloy having a coefficient of thermal expansion (CTE) of between about 3 micrometers per meter for each degree Celsius (ppm/° C.) and about 16 ppm/° C., or a dielectric such as silicon nitride. Further, the diaphragm 102 may be generally flexible, such that the diaphragm 102 is configured to deflect during use of the actuator assembly 100, so as to eject ink through an adjacent structure, such as a port or nozzle.

The array of actuators 104 can be disposed generally adjacent to the diaphragm 102, and can be coupled thereto. The actuators 104 can include one or more piezoelectric transducers configured to deflect when an electrical current is applied thereto. Deflection of the actuators 104 may cause adjacent portions of the diaphragm 102 to correspondingly deflect. It will be appreciated that the actuator assembly 100 may include any number of actuators 104, for example, tens, hundreds, thousands, or more, separated by any suitable distance.

The standoff layer 106 may be disposed generally adjacent to the array of actuators 104, with the array of actuators 104 being disposed between the diaphragm 102 and the standoff layer 106. The standoff layer 106 may be constructed at least partially from silicon dioxide, SU-8 photoresist, another type of dielectric material, combinations thereof, and/or the like. In some embodiments, the standoff layer 106 may exhibit adhesive properties, so as to bond to the array of actuators 104, for example. In at least one embodiment, the standoff layer 106 can be at least partially constructed of a pressure-sensitive adhesive, a curable adhesive, combinations thereof, and/or the like. Such adhesives may exhibit a sufficiently low modulus to avoid transmitting movement between adjacent actuators 104, but strong enough to provide sufficient adhering force. One example of such an adhesive may be an acrylic. In another example, the standoff layer 106 may be constructed at least partially of a silicone compound such as dialkyl silicone, wherein the alkyl groups can be chosen from $C_1$ to $C_4$ alkyls, such as methyl and ethyl. For example, the dialkyl silicone can be dimethyl silicone. In other embodiments, the standoff layer 106 can exhibit no, or at least negligibly little, adhesive properties, such additional adhesives (e.g., pressure sensitive and/or curable adhesives) and/or other coupling devices, processes, etc. may be employed to maintain the position of the standoff layer 106 with respect to the array of actuators 104.

The standoff layer 106 may further be formed with a plurality of apertures 110 extending therethrough. The apertures 110 may be disposed in any suitable pattern. For example, the number of apertures 110 may correspond to the number of actuators 104, with the apertures 110 providing an opening through the standoff layer 106 to provide access to the actuators 104.

The flexible printed circuit 108 may include a substrate or "body" 112 having a top side 114 and a bottom side 116, with the bottom side 116 being opposite the top side 114 and facing generally toward the diaphragm 102. It will be appreciated that "top," "bottom," "up," "down," "left," "right," as well as any other directional terms, are intended merely as a convenient way to refer to relative relationships between components, as illustrated in the Figures provided herein, and is not intended to be limiting on the orientation of the components outside of this context (e.g., relative an absolute plane). Moreover, the flexible printed circuit 108 may be a metallized electrical interconnect layer, for example, with the body 112 being generally formed from a layer of polyimide, and having conductive traces formed therein, which may be coupled with contact pads 118. The traces may extend along the bottom side 116 of the body 112, and may be coupled with a power source via an application specific integrated circuit (ASIC), another type of integrate circuit, and/or the like. Moreover, the traces and/or contact pads 118 may be formed from gold, silver, copper, combinations thereof, and/or any other electrically conductive element. Further, the traces and contact pads 118 may be formed form the same or different materials.

In some embodiments, the bottom side 116 of the body 112 may be covered with a solder mask to insulate the traces. The solder mask may be etched to expose portions of the bottom side 116, for example, the contact pads 118. In other embodiments, a solder mask may not be needed, as the dielectric properties of the standoff layer 106 may adequately insulate the electrically conductive components of the flexible printed circuit 108 from undesired electrical contact.

The body 112 of the flexible printed circuit 108 may also include plurality of protrusions or "bumps" 120. The bumps 120 may extend downward with respect to the bottom surface 116 of the remainder of the body 112. Further, the bumps 120 may be aligned with the apertures 110 and the actuators 104, such that the body 112 extends through the standoff layer 106 via the bumps 120. The contact pads 118 may be disposed on the bottom side 116 at least partially at the bumps 120, such that the contact pads 118 may contact the actuators 104, for example, with each contact pad 118 being positioned to contact each actuator 104 in a 1:1 relationship, for example. Although nine bumps 120 are shown, it will be appreciated that a single actuator assembly 100 can include any number of bumps 120, for example, tens, hundreds, thousands, or more, for example, according to the number of actuators 104 present.

The body 112 may also include a plurality of cutouts 122, defining areas of reduced or zero thickness in the body 112 of the flexible printed circuit 108. Such areas of reduced or zero thickness are referred to herein as "reliefs" 123, with a single relief 123 including an area containing one or more cutouts 122. The cutouts 122 may formed by cutting, milling, drilling, etching, laser ablating, or otherwise removing portions from the body 112; however, in other embodiments, the cutouts 122 may be cast or molded during the construction of the body 112. Various other suitable processes may be employed, as will be recognized by one with skill in the art, to produce reliefs 123.

Further, the reliefs 123 may be positioned between two or more adjacent bumps 120 and/or contact pads 118 and may be disposed in any suitable pattern, for example, in rows of generally parallel reliefs 123, as shown. However, in some embodiments, the reliefs 123 can extend at angles to one another and need not be uniformly aligned. At least some of the reliefs 123 may be defined between adjacent rows of bumps 120, as shown; however, in various embodiments, the reliefs 123 can be disposed between columns of bumps 120, in addition to or in lieu of being between the adjacent rows.

As shown, the cutouts 122 of the reliefs 123 may be openings, extending through the body 112, such that the thickness of the body 112 is reduced to zero at the reliefs 123. Further, the cutouts 122 may be shaped as elongate slots, as shown, although this is but one shape among many contemplated herein. In other embodiments, the reliefs 123 may be formed from one or more holes, one or more semicircles, one or more rectangles and/or other polygons, combinations thereof, and/or the like. Further, the reliefs 123 may be uniform, such that the one or more cutouts 122 forming each of the reliefs 123 are substantially the same in shape, size, and, where applicable, pattern as all the rest. In other embodiments, one or more can be non-uniform reliefs 123 may be provided, for example, providing various groups of differently-shaped reliefs 123. Moreover, the reliefs 123 may be defined by two or more cutouts 122, which may be overlapping, for example, a groove defined in the body 112, with holes cut through the body 112 in the groove, chamfered holes, stepped grooves or holes, etc.

Figure 2:
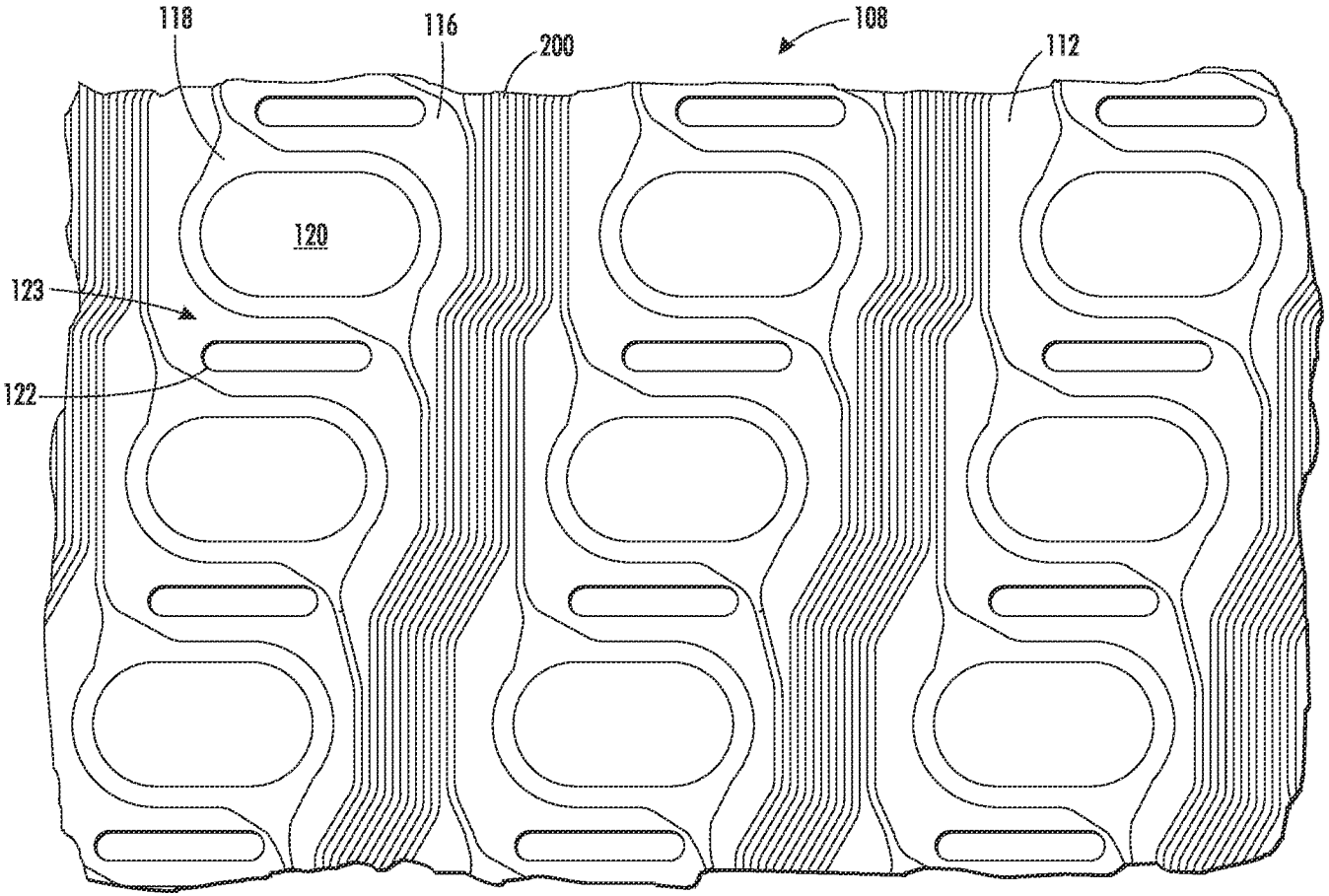
FIG. 2 illustrates a partial plan view of a flexible printed circuit, for use in actuator assembly, according to an embodiment.

FIG. 2 illustrates a schematic plan view of the flexible printed circuit 108, according to an embodiment, viewing the bottom side 116 thereof with the solder mask (if present) being omitted for purposes of illustration. As shown, the flexible printed circuit 108 may include arrays of conductive traces 200, which, as noted above, may be any suitably conductive material, such as gold, silver, copper, alloys, etc. The traces 200 may extend along the body 112 and may each couple with one or more of the contact pads 118. In various embodiments, the traces 200 and associated contact pads 118 may be generally integral, formed from a variety of deposition or other forming process of a uniform material; however, in other embodiments, may be discrete components which may be electrically coupled together.

As also shown in FIG. 2, the reliefs 123 may be disposed between adjacent contact pads 118 (which may reside at least partially on the bumps 120, shown in and described above with reference to FIG. 1). In some embodiments, the contact pads 118 may be disposed closer together in one direction than in another, for example, as shown, the contact pads 118 may be disposed more closely adjacent up-and-down, than from left-to-right. This additional spacing in the illustrated horizontal axis may allow room for the traces 200 to extend between the contact pads 118. Further, the traces 200 may extend generally parallel to one another, except where they meet the associated contact pads 118, and thus may leave areas where no traces are formed. In the illustrated embodiment, this area where no traces are formed corresponds to the area between the contact pads 118 in the more closely adjacent, vertical axis. The reliefs 123 may be positioned in this area, as shown, as this may avoid exposing and/or severing the traces 200, while reducing mechanical coupling between the more closely adjacent contact pads 118. In some situations, the greater spacing between the horizontally adjacent contact pads 118 may be sufficient to attenuate any vibration as between the adjacent contact pads 118.

Referring now to both FIGS. 1 and 2, in an example of operation of the actuator assembly 100, the contact pads 118 may act as a signal electrode, providing an active signal to the actuators 104. For example, the contact pads 118 can act as positive electrodes, while the diaphragm 102 acts as a ground; however, this polarity can be reversed and/or modified and is merely one example among many contemplated herein. When an electrical current is supplied, e.g., via signal from the ASIC, the current may travel through one or more of the traces 200, to the contact pad 118, and then to a specified one or more of the actuators 104. The actuator 104 may then deflect, causing corresponding deflection of an adjacent portion of the diaphragm 102.

The movement of the actuator 104 (and/or the diaphragm 102) may be transmitted to the bump 120 via the physical connection therebetween, thus mechanically coupling the actuator 104 and the body 112 of the flexible printed circuit 108. Accordingly, the body 112 of the flexible printed circuit 108 may move along with the actuator 104. To avoid transmitting, or at least reduce the transmission of, this movement to adjacent actuators 104, the reliefs 123 may be provided, thereby reducing the stiffness of the flexible printed circuit 108 between adjacent bumps 120 and attenuating any movement transfer therebetween.

Figure 3:
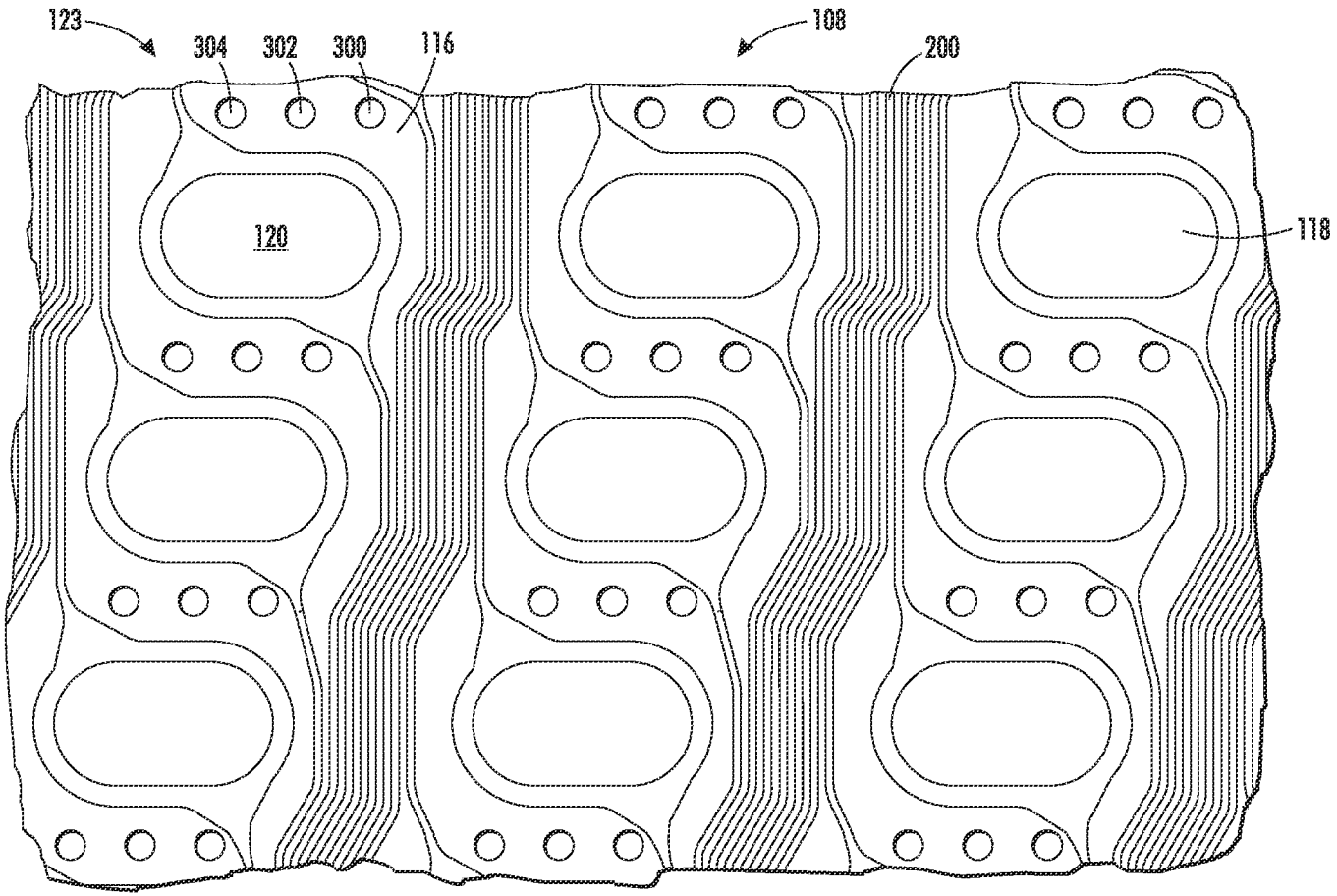
FIG. 3 illustrates a partial plan view of another embodiment of the flexible printed circuit.

FIG. 3 illustrates a schematic plan view of the bottom side 116 of the flexible printed circuit 108, according to another embodiment. As shown, rather than being formed from elongate slots, the reliefs 123 can include a plurality of round holes 300, 302, 304. The holes 300-304 can be formed using the same or similar cutting, milling, etc. processes as discussed above with respect to the elongate slot cutouts 122, and, further, may serve a similar, stiffness-reducing function. Furthermore, it will be appreciated that in some embodiments, in a single flexible printed circuit 108, some of the reliefs 123 may be or include elongate slot cutouts 122, while others may be holes 300-304. Additionally, in some cases, a single relief 123 may include both holes and slots, whether overlapping or adjacent.

Figure 4:
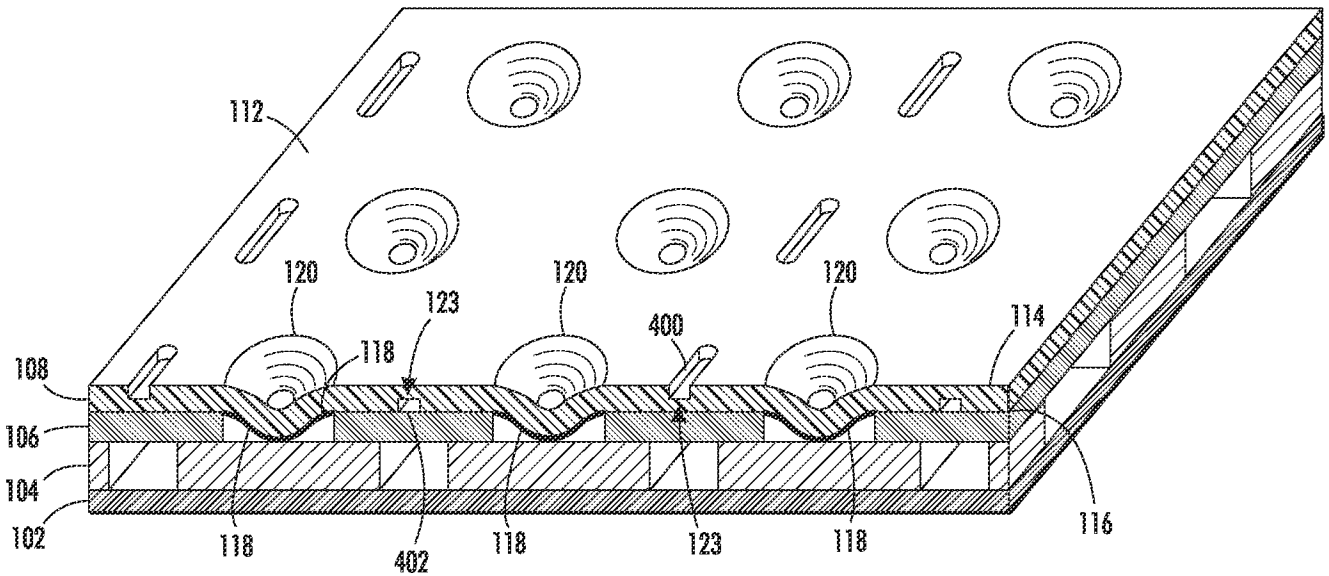
FIG. 4 illustrates a partial perspective view of another embodiment of the actuator assembly.

FIG. 4 illustrates a perspective view of a section of the actuator assembly 100, according to another embodiment. As shown, the reliefs 123 need not be areas of zero thickness in the body 112. Instead, the body 112 can have a reduced, but non-zero, thickness at the reliefs 123. In such embodiments, as shown, cutouts 400 formed at the reliefs 123 can be grooves, extending partially through the body 112. In other embodiments, the cutouts 400 can be or include blind holes extending partially through the body. In at least one embodiment, at least one of the reliefs 123 can be defined by a blind hole cutout 400 and an adjacent through-hole cutout 122 (FIG. 1).

The partial-depth cutouts 122 defining the reliefs 123 may extend from either the top side 114 of the body 112 or the bottom side 116. For example, as shown, partial depth cutout 400 extends from the top side 114. This may provide an additional layer of protection from severing or exposing the traces 200 (FIG. 2), since the traces 200 may run along the bottom side 116 of the body 112. However, in some cases, it may be more convenient to manufacture the partial-depth cutouts extending from the bottom side 116, as illustrated by partial-depth cutout 402. For example, milling, etching, or other forming operations may take place on the bottom side 116 of the body 112. Accordingly, rather than flipping the flexible printed circuit 108 during manufacture, it may be advantageous to form the reliefs 123 by extending the partial depth cutouts 402 from the bottom side 116.

In various embodiments, some of the reliefs 123 may be formed by cut-outs 402 extending from the bottom side 116, while others in the same flexible printed circuit 108 may be formed from cut-outs 400 extending from the top side 114. While this is one potential embodiment, nothing in the present disclosure, however, is intended to require a single flexible printed circuit 108 with both cutouts 400 and 402. Furthermore, in some embodiments, a combination of zero-thickness reliefs 123 and non-zero thickness, reliefs 123 may be employed in a single flexible printed circuit 108.

Figure 5:
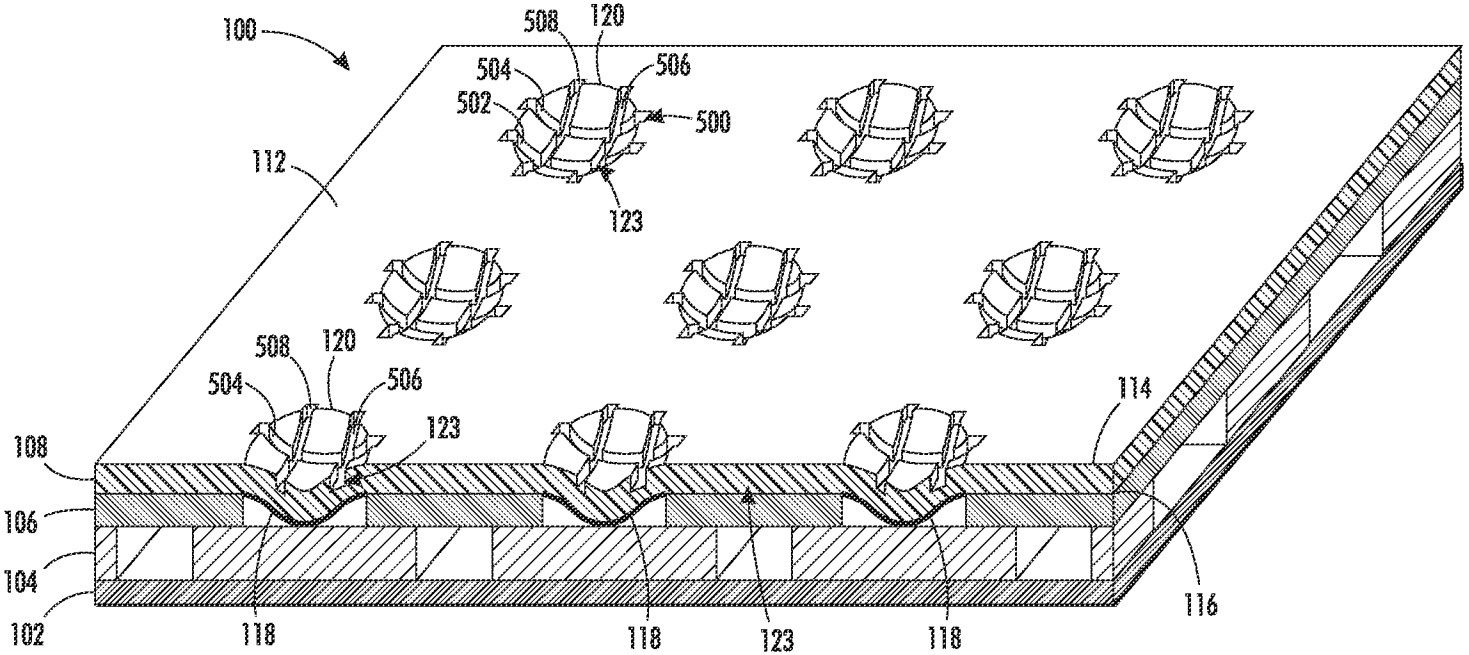
FIG. 5 illustrates a partial perspective view of yet another embodiment of the actuator assembly.

FIG. 5 illustrates another perspective view of the actuator assembly 100, according to another embodiment. In the illustrated embodiment, the reliefs 123 may be formed as a pattern of cutouts 500 at the bumps 120. The cutouts 500 may be formed from a lattice pattern of crossing grooves 502, 504, 506, 508. Although four grooves 502-508 are shown, it will be appreciated that any number of grooves may be employed. Accordingly, the stiffness of the body 112 at the bumps 120 may be reduced, thereby reducing transmission and/or propagation of the movement of the bumps 120 with the actuators 104.

Figure 6:
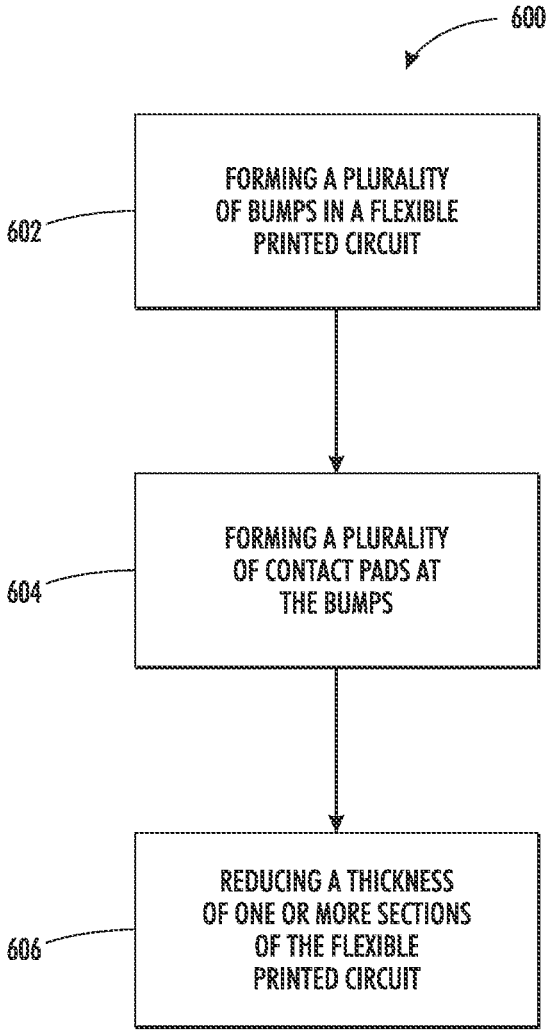
FIG. 6 illustrates a flowchart of a method for forming an electrical interconnect in an actuator assembly for a print head, according to an embodiment.

FIG. 6 illustrates a flowchart of a method 600 for forming an electrical interconnect in an actuator assembly for a print head, such as, for example, one or more embodiments of the actuator assembly 100. The method 600 may include forming a plurality of bumps in a flexible printed circuit, as at 602. Various methods of forming bumps in a flexible printed circuit are known and any suitable formation process may be employed.

The method 600 may also include forming a plurality of contact pads at least at the plurality of bumps, as at 604. The contact pads may be electrically coupled to a power source, e.g., via one or more traces and/or an integrated circuit such as an ASIC, to selectively apply electrical current to the contact pads. The contact pads may also be in physical contact with an actuator, such that the current selectively applied to the contact pads may be passed to the actuator.

The method 600 may further include reducing a thickness of the flexible printed circuit, as at 606, to reduce mechanical coupling (transmission of movement) between two or more of the plurality of contact pads. In an embodiment, reducing the thickness at 606 may include forming a relief by providing a cutout in the flexible printed circuit extending partially or entirely therethrough. If the cutout extends partially through, the flexible printed circuit may have a non-zero thickness at the relief; however, if the cutout extends entirely through, the flexible printed circuit may have a zero thickness at the relief. Further, embodiments in which the flexible printed circuit includes cutouts extending entirely therethrough and cutouts extending partially therethrough, whether as part of the same relief or different reliefs, are expressly contemplated.

Additionally, reducing the thickness at 606 may also include reducing the thickness between two of the plurality of bumps and/or between two of the plurality of contact pads. In at least one example, adjacent contact pads may be more closely adjacent in one direction than in another, in such an example, the reliefs may be disposed between the pads in the more closely adjacent direction.

Further, in at least one embodiment, reducing the thickness at 606 includes forming an elongate groove, an elongate slot, a through-hole, a blind hole, a semicircle, another shape, or a combination thereof, between adjacent ones of the plurality of bumps and/or contact pads. In another embodiment, reducing the thickness at 606 may include forming a pattern, such as a lattice pattern, of grooves in the flexible printed circuit at least partially aligned with the plurality of contact pads and/or at least partially at the plurality of bumps.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An actuator assembly for an inkjet printer, comprising:

an array of piezoelectric actuators;

a diaphragm coupled with the array of piezoelectric actuators, wherein the diaphragm is configured to displace a volume of ink when one or more of the array of piezoelectric elements is excited;

a standoff layer disposed adjacent to the array of piezoelectric actuators, such that the array of piezoelectric actuators is disposed between the standoff layer and the diaphragm, the standoff layer defining apertures therethrough aligned with at least some of the array of piezoelectric transducers; and a flexible printed circuit disposed adjacent to the standoff layer, the flexible printed circuit comprising:

a body having a top side and a bottom side, the body defining a plurality of bumps extending from the bottom side, the plurality of bumps being aligned with and extending at least partially through the apertures of the standoff layer;

a first embossed contact pad disposed on the bottom side of the body and at least partially at one or more of the plurality of bumps, the first embossed contact pad physically contacting at least one of the array of piezoelectric transducers; and a second embossed contact pad disposed on the bottom side of the body and at least partially at one or more of the plurality of bumps, the second embossed contact pad physically contacting at least one of the array of piezoelectric elements, wherein the body comprises at least one cutout relief configured to reduce movement of the second embossed contact pad caused by movement of the first embossed contact pad.

2. The assembly of claim 1, wherein the at least one cutout relief extends partially through the body, such that the cutout relief defines an area of reduced thickness in the body.

3. The assembly of claim 1, wherein the at least one cutout relief is defined between the first and second embossed contact pads.

4. The assembly of claim 1, wherein the at least one cutout relief defines a lattice pattern in the body overlaying the first embossed contact pad, the second embossed contact pad, or both.

5. The assembly of claim 1, wherein the body has a thickness of zero at the at least one cutout relief, such that the at least one cutout relief defines one or more openings through the body.

* * * * *